US005098085A

United States Patent [19]

Abboudi et al.

[11] Patent Number: 5,098,085

[45] Date of Patent: Mar. 24, 1992

[54] EXERCISE APPARATUS FOR UNDERWATER USE

[75] Inventors: Shalom Y. Abboudi, Highland Park; Mark Williams, New Brunswick, both of N.J.; Frank Alberino, Hamden; Robert Adley, Madison, both of Conn.

[73] Assignee: Water Products Research Co., Metuchen, N.J.

[21] Appl. No.: 466,870

[22] Filed: Jan. 18, 1990

[51] Int. Cl.[5] ..... A63B 21/00

[52] U.S. Cl. ..... 272/97; 272/1 B; 272/71; 272/116; 440/17

[58] Field of Search ..... 272/1 B, 69, 70, 71, 272/97, 116, 128, 130, DIG. 4; 440/13, 17

[56] References Cited

U.S. PATENT DOCUMENTS

| | | | |
|---|---|---|---|
| 143,270 | 9/1873 | Beekman | 440/17 X |
| 1,279,633 | 9/1918 | Allen | 272/116 |
| 3,424,133 | 1/1969 | Brady | 272/116 X |
| 3,984,102 | 10/1976 | Evans | 272/130 |
| 4,458,896 | 7/1984 | Solloway | 272/116 |
| 4,784,385 | 11/1988 | D'Angelo | 272/116 X |
| 4,804,178 | 2/1939 | Friedebach | 272/97 |
| 4,807,877 | 2/1989 | Buxton | 272/116 X |

FOREIGN PATENT DOCUMENTS

| | | | |
|---|---|---|---|
| 2911023 | 9/1980 | Fed. Rep. of Germany | 440/17 |
| 119588 | 9/1980 | Japan | 440/17 |

*Primary Examiner*—Robert Bahr

*Attorney, Agent, or Firm*—Henry I. Schanzer; Michael Y. Epstein

[57] ABSTRACT

In exercise apparatus for underwater use including an apparatus frame, and movable members mounted on the frame to be moved by a user of the apparatus, flap members, e.g., flat plates, are mounted on the movable members for movement therewith within the surrounding water. The water resists movement of the flap members, hence provides resistance to movement of the members moved by the user. Disclosed are apparatus which, in use, simulate the movements of a cross-country skier, an ice-skating speed racer, and a rower of a row boat. Stop are also disclosed for selectively varying the resistance to movement provided by the flap members in response to the direction of movement of the movable members. All exercises with with equipment embodying the invention can be performed with all of the user's body and limbs being submerged in water in order to decrease strains on the user's joints and thereby providing an exercise mechanism which incorporates high resistance to the user's muscles with low impact on the user's joints.

10 Claims, 3 Drawing Sheets

EXERCISE APPARATUS FOR UNDERWATER USE

BACKGROUND OF THE INVENTION

This invention relates to exercise apparatus for use in a body of water which supports the weight of the user, and particularly, but not limited to, to therapeutic exercise apparatus wherein the effort required by the user is continuously and instantaneously variable for accommodating the instantaneous needs of each user.

It is generally known that the performance of various exercises while the exerciser's body is at least partially submerged in water makes it possible to exercise only desired muscles while avoiding undesired stresses on other portions of the exerciser's body. This is particularly important for persons who are exercising for therapeutic purposes, e.g., in the recovery from an accident or illness. In such instances, it is essential that the exercise be performable in a non-stressful manner, with only the desired muscles being exercised and at only a selected level of stress and effort.

Any number of exercise apparatus exist for exercising different muscles of the human body, see, for example, U.S. Pat. Nos. 4,529,194 and 4,659,077, the subject matter of which are incorporated herein by reference. However, when it is contemplated to use these known apparatus for therapeutic type exercising, and particularly for underwater use, various problems are presented.

A major one of such problems is that, in order to provide resistance to movement of various apparatus parts manipulated by the user, to provide the desired exercise, various weights, springs, levers and the like are used which generally provide, for a given setting, a fixed amount of resistance. In therapeutic exercising, however, where the exerciser can be in a quite weakened and easily tired condition, any level of fixed resistance can be undesirable as causing excessive tiring and stressing of the user. What is desired is a continuously variable resistance which is instantaneously responsive to the user's needs.

Another problem associated with the use of known exercise apparatus in an underwater environment is that water, and particularly chlorinated water, is corrosive, and the known apparatus, which employ pulleys, springs and the like to provide resistance to movement of the apparatus engaged members, are not well suited for use in such environment. The movable parts tend to quickly corrode, and providing proper lubrication of the movable parts is particularly troublesome. A need exists, therefore, for exercise apparatus of the aforementioned type which, however, is better suited for underwater use and which, preferably, is less complicated and easier to manufacture.

SUMMARY OF THE INVENTION

In general, in each of the specific apparatus described hereinafter, various members are provided on the apparatus for engagement and movement by the exerciser's hands and/or feet, and simple means are provided attached to the members for providing resistance to movement thereof. Such means comprise extending flaps or paddles which are positioned on the apparatus and disposed beneath the surface of the water in which the apparatus is used, the amount of resistance to movement provided by the flaps being a function of the size and positioning thereof, and upon the speed of movement thereof through the water. Preferably, simple, removable attachment means are used whereby changes in these parameters can be readily made to vary the resistance to movement in accordance with a user's needs.

In one embodiment of the invention, the position of the flap relative to the member to which it is attached is a function of the direction of movement of the member, whereby the amount of resistance provided by the flap varies with the direction of movement.

In each embodiment of the invention, as mentioned, the resistance to movement provided by the flaps is a function of the speed of movement of the flaps through the water. In general, relatively large variations in resistance to movement are obtained with relatively small changes in the rate of movement of the flaps. Thus, solely in response to relatively small changes in the rate of movement of the apparatus parts, significant and instantaneous changes in the effort required by the user are obtained.

DESCRIPTION OF THE PREFERRED EMBODIMENTS

The basic invention, a flap means mounted on a movable part of an exercise apparatus, can be used on a wide variety of different apparatus for exercising different muscles. Such apparatus can also be of the type which, in use, simulate a certain athletic activity.

Figure 1:
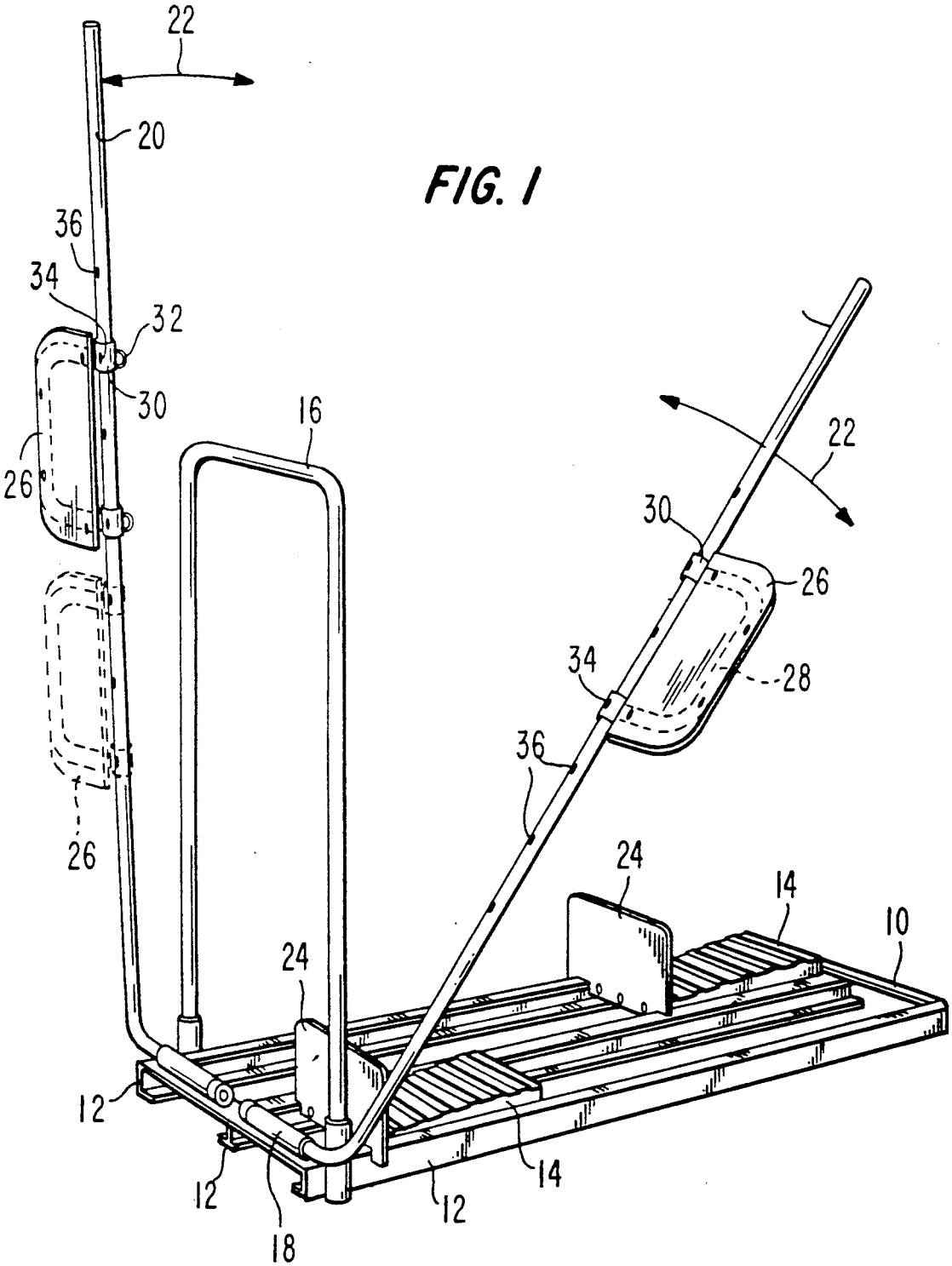
FIG. 1 is a view, in perspective, of one underwater exercise apparatus in accordance with this invention.

FIG. 1 shows apparatus which simulates, in use, the movement of a cross-country skier. Similar type apparatus are shown in the aforementioned U.S. Pat. Nos. 4,529,194 and 4,659,077, but the apparatus of these patents are not well suited for underwater, therapeutic-type exercises.

The apparatus shown in FIG. 1 comprises a bottom frame 10 including three channel-shaped, elongated, and parallel bars 12 extending from the front (the left side of the drawing) to the back of the apparatus. Each pair of adjacent bars 12 defines a track for forward and backward movement of a foot engaged, or supporting, member 14. Although not shown, each member 14 includes a pair of axles on which the member is mounted, the axles having wheels on the ends thereof which are received within the channels of the bars 12 for guided movement therealong.

Mounted on the front end of the apparatus is a U-shaped member 16 which serves as a hand hold for the user as he/she mounts and dismounts from the apparatus.

Also mounted on the front end of the frame are a pair of cylindrical bushings 18 for receipt of a pair of L-shaped poles 20, the ends of the poles being freely rotatable within the bushings 18. Thus, each pole 20 is freely rotatable within a vertical plane as shown by the arrows 22.

In accordance with this invention, flaps or paddles 24 and 26 are mounted on each of the foot supporting members 14 and poles 20, respectively. The flaps 24 can comprise, for example, flat plates of a plastic material attached, as by screws, to the front end of the members 14. The flaps 26 are somewhat larger than the flaps 24 and, to provide a more rigid structure, the flaps 26 comprise two plates secured to opposite sides of a C-shaped support 28, each arm of which terminates in a hollow cylinder 30. The cylinders 30 are mounted on the poles 20 in slidable fit therewith and are held in place by pins 32 which extend through aligned holes 34 through the cylinder 30 walls and through corresponding holes 36 through and spaced along the poles 20. By this mounting arrangement, the positioning of the flaps 26 along the poles is readily changed. Also, the flaps 26 can be easily removed and replaced with different flaps, as desired to change the resistance. Instead of using different size flaps to vary the resistance, a flap can be rotated about the pole 20 so that the flap is not perpendicular to the motion of travel of pole 20, whereby the resistance of the flap in the water is decreased relative to the perpendicular position.

In use, the apparatus is disposed on the bottom of a pool of water, ranging, for example, from 2 to 6 feet deep. A user stands on the apparatus with one foot on each of the two foot members 14 (a foot stirrup being provided, if desired). The user grasps the poles 20 in his hands and moves his feet and arms in the movement of a cross-country skier, the foot members 14 corresponding to ski boots attached to skis, and the poles 20 corresponding to ski poles.

The flaps 24 and 26 are disposed beneath the surface of the water, and the flaps, which extend rigidly in planes generally perpendicular to the direction of movement of the members to which they are attached, provide resistance to movement of these members. The amount of such resistance to movement is a function of the size of the flaps, the speed of movement thereof through the water and, in the case of the flaps 28 on the poles 20, the position of the flaps along the poles 20 (and the angle of the flaps relative to the motion of the poles). Thus, the greater the distance of the flaps 28 from the bushings 18, the greater the resistance to rotational movement of the pivoted poles 20.

As previously mentioned, relatively large variations in resistance to movement of the flaps through the water are obtained with relatively small changes in the rate of movement of the flaps, i.e., the rates of movement of the members to which the flaps are attached. Thus, solely by changing the rate of movement of the user's arms and feet, by relatively small amounts, relatively large and instantaneous changes are provided in the amount of force required to move the foot members 14 and the poles 20. Accordingly, even with a given setting (size and position) of the flaps, the most gentle to a quite vigorous workout can be obtained by the user.

Also, in comparison with the various mechanical systems of the known apparatus, the flap means shown therein are extremely simple, inexpensive and well suited for underwater use.

In the embodiment shown in FIG. 1, the resistance to movement is the same for both directions of movement of the foot members 24 and the poles 20. In the embodiment shown in FIG. 2, which shows a side view of a portion of a modified foot member 24*a*, a movable flap 40 is shown which is rotatable between two positions in response to the direction of motion of the member 24*a*. Thus, as shown, the flap 40 is rotatably mounted on a hinge 42 which includes a ledge 44 mounted on the hinge 42 and extending parallel thereto (i.e., perpendicular to the plane of the drawing of FIG. 2). The ledge 44 is also rotatably mounted on the hinge, but is in a tight fit therewith so as to retain its angular position with respect to the hinge axle after being moved, as by hand, to a selected angular position.

Figure 2:
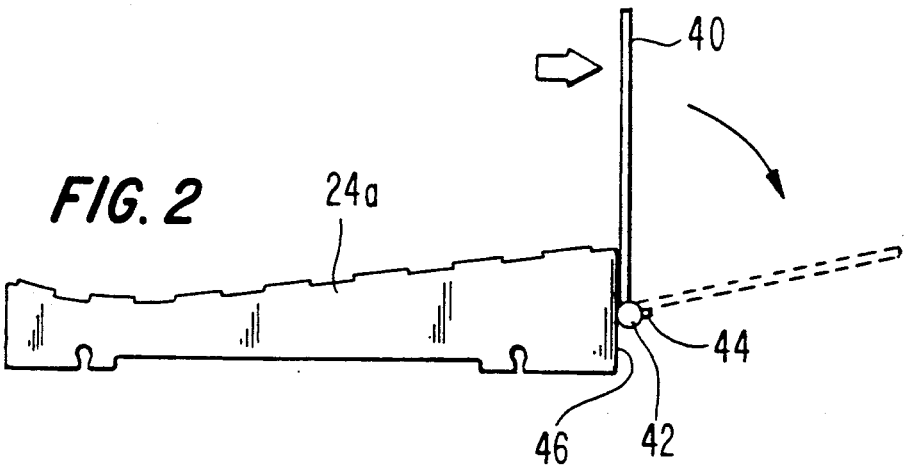
FIG. 2 is a side view, on an enlarged scale, of a modification of the foot engaged members of the apparatus shown in FIG. 1.

As indicated in FIG. 2, the flap 40 is rotatable between two fixed positions; one in the vertical position shown in solid lines, where the flap 40 is pressed against a rear wall 46 of the member 24*a*; and the other in a near-horizontal position, shown in dashed lines, where the flap 40 is pressed against the ledge 44.

With respect to the apparatus frame 10 shown in FIG. 1, the flap 40 (FIG. 2) is mounted on the rear side of the member 24*a*. Thus, when a user's foot is moving the member 24*a* forward, water resistance flips the flap backward against the ledge 44, and the resistance to forward movement provided by the flap 40 is relatively small In the backward movement of the member 24*a*, the flap is flipped forward by movement through the water until the flap 40 is pressed against the member wall 46 and in vertical position. In such position, the flap provides increased resistance to movement. Alternatively, the flap mechanism may be designed to provide greater resistance to forward motion and little resistance to backward motion in order to stress different muscles.

The result of the arrangement shown in FIG. 2 is that the resistance to movement of the foot member 24*a* is variable and is a function of the direction of movement of the member 24*a*. Such direction variable resistance corresponds more closely to what a cross-country skier actually experiences.

Figure 3:
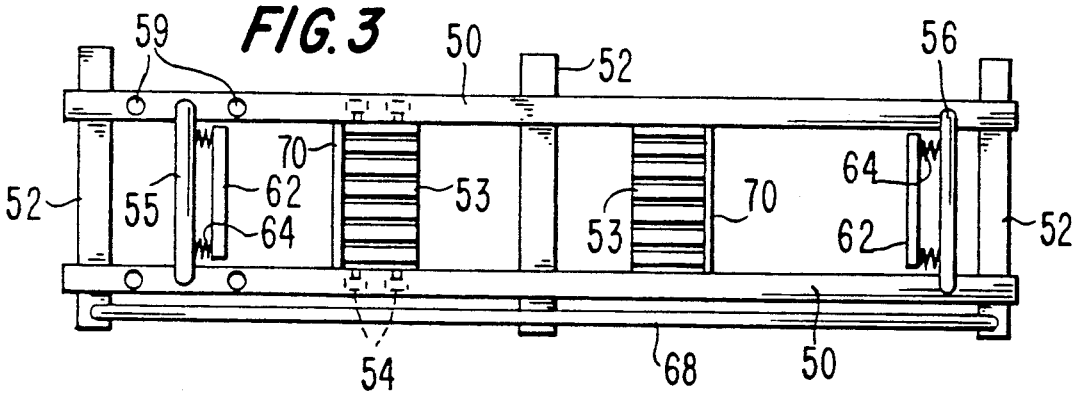
FIG. 3 is a plan view of another apparatus according to the invention.
Figure 4:
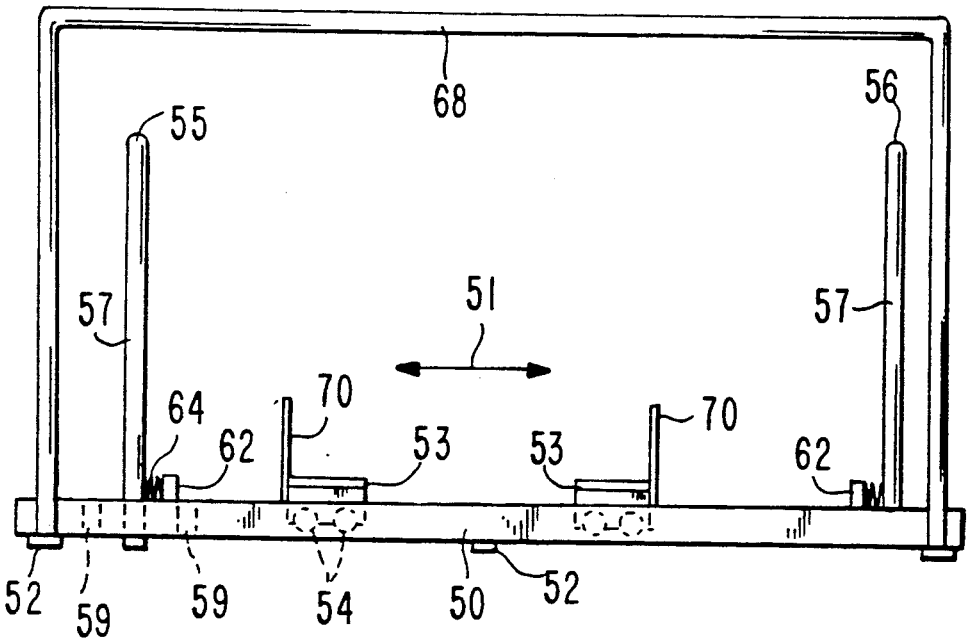
FIG. 4 is a side view of the apparatus shown in FIG. 3.

FIGS. 3 and 4 show an exercise apparatus designed to develop and strengthen the hip abductor and adductor muscles as well as the ankle invertors and evertors. In use, the apparatus generally simulates the movements of an ice-skating speed racer. In such activity, the racer successively thrusts one leg substantially directly sideways, slides the other leg toward the first, and then repeats the process in the other direction.

The apparatus shown in FIGS. 3 and 4 comprises a pair of channel-shaped bars 50 similar in shape to the outer side bars 12 shown in FIG. 1, the two bars defining a sideways extending track (in the direction of arrow 51 in FIG. 4). The bars 50 are maintained in proper spaced-apart relation by means of flat plates 52 secured to the bars. A pair of foot members 53 generally similar to the ones shown in FIGS. 1 and 2 is each mounted on axles terminating in wheels 54 received within the channels of the bars 50. Both foot members 53 are mounted on the same (sole) track for side to side movement in the direction of the arrow 51.

To control the maximum side-to-side movement of the foot members 53, a pair of U-shaped bars 55 and 56 are mounted one at each end of the apparatus. The vertical legs 57 of the bar 56 are rigidly secured to the side bars 50, while the vertical legs 57 of the bar 55 are removably supported within vertical openings 59 through the bars 50. Several such openings are provided spaced along each bar 50, whereby the position of the bar 55 is readily changed for adjusting the effective length of the tracks. By changing the length of the track, the side-to-side extension can be increased or decreased, as desired.

Each bar 55 and 56 is provided with a bumper rail 62 mounted, via springs 64, between the bar legs 57 to provide a spring cushioned barrier to movement of the foot members 53.

Another U-shaped bar 68, serving as a hand rail for the user, is mounted on the two support plates 52 and extends across the front of the apparatus.

The wheels 54 of the foot members 53 roll freely within the channels within the bars 50. To provide resistance to movement of the foot members 53, within a water environment, each foot member 53 is provided with a plate-like flap 70, similar to the flap 24 shown in FIG. 1, mounted on each side of the members 53 so as to be disposed in planes perpendicular to the directions of movement of the members 53. The flaps 70 can be attached to the walls of the members 53 by removable fasteners, e.g., screws, whereby the flaps are readily replaceable with different size flaps to provide a desired degree of resistance to movement.

To avoid this contact between the flaps 70 and the user's feet, the flaps 70 are disposed on the outside, i.e., non-facing side surfaces of the members 53.

Figure 5:
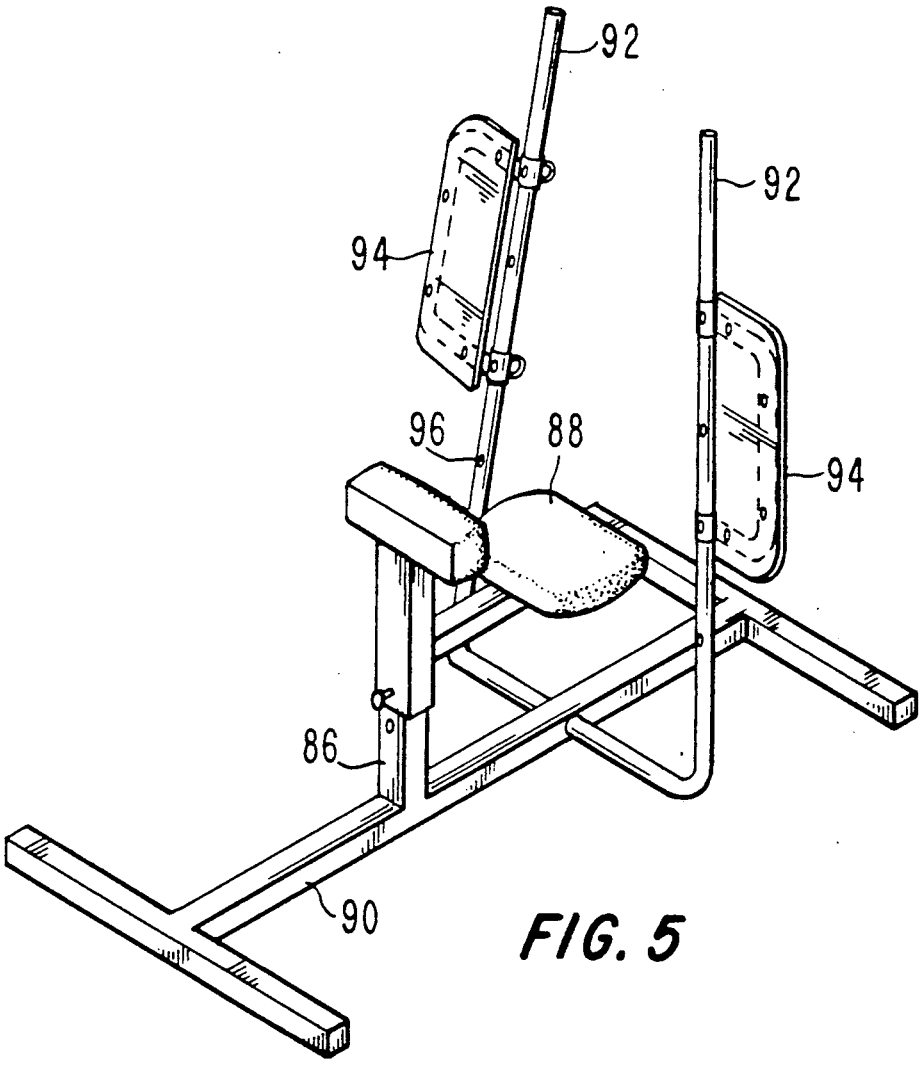
FIG. 5 is a view, in perspective, of still another apparatus according to the invention; such apparatus being a row boat simulating apparatus.

FIG. 5 shows a row boat exercise apparatus. The apparatus comprises a seat 88 mounted on a vertical column 86 supported in turn on a base frame 90. Rotatably mounted within bushings (not shown) on the frame are a pair of L-shaped poles 92 corresponding to the oars of a row boat. The poles are movable independently of one another. To provide resistance to movement of the poles 92, flaps 94 substantially identical to the flaps 26 shown in FIG. 1 are mounted on the poles via spaced-apart holes 96 through the poles. As in the FIG. 1 embodiment, the resistance to movement provided by the flaps 94 is a function of the distance thereof from the axis of rotation of the poles and the angular positioning of the flaps on the poles.

In use, the apparatus is disposed on the bottom of a pool of water sufficiently deep to completely submerge the flaps 94. The "rowing" of the poles 92 is substantially identical to the rowing of the oars of a row boat, the resistance to movement of the poles 92 being determined by the resistance to movement of the poles (and flaps) through the water. The advantage of the use of the flaps 94, however, is the simplicity and low cost thereof, and the ease with which the resistance characteristics can be changed.

The column 86 and feet 88 of the row boat-like apparatus may be lowered or raised (as shown in FIG. 5) to enable the user's entire torso including the user's arms and legs to be totally submerged. The water then provides support for the arms and shoulders of the user and thereby enhances the therapeutic use of the equipment by the user.

What is claimed is:

1. An exercise apparatus submergeable in a body of water for enabling therapeutic exercise to be performed underwater, said exercise apparatus comprising support means for maintaining the exercise apparatus in a stationary position on the bottom of the body of water, a rigid movable member rotatably mounted on said support means and a flap means mounted on said movable member and extending from said movable member for movement therewith, said movable member rotatably mounted on said support at a rotation point such that, in use of the apparatus on the bottom of said body of water, said support, said rotation point and the bottom of the body of water cooperate so as to retain said flap means substantially at or above said rotation point, and the resistance to movement of the flap means through the water provides resistance to movement of the movable member.

2. An apparatus according to claim 1 wherein said flap means comprises a flat plate and means for varying the orientation of said plate relative to said member from which it extends for selectively varying the amount of resistance to movement of said member provided by said plate.

3. An apparatus according to claim 2 wherein said orientation varying means varies the orientation of said plate in response to the direction of movement of said movable member.

4. An apparatus according to claim 1 wherein said movable member includes a pair of movable members each of which comprises an elongated pole, an end of each said pole being rotatably mounted on said support means, whereby said poles can be moved backwardly and forwardly relative to said support means by a user of the apparatus.

5. An apparatus according to claim 4 wherein said support means includes a pair of parallel rail means, and including a second pair of movable members each of which is adapted to be engaged by a different foot of a user of the apparatus and each of which is mounted for movement back and forth along a different one of said rail means, and a flap means mounted on each of said second pair of movable members for providing resistance within the pool water to movement of said second pair of movable members and the user's feet.

6. An apparatus according to claim 4 wherein said flap means comprise two plates secured to opposite sides of a C-shaped support member including a pair of arms each of which terminates in a hollow cylinder, said cylinder being mounted on one of said poles in a slidable fit therewith, said poles including a plurality of holes spaced apart along the length of the poles, said cylinders having holes therethrough along axes parallel to the axes of the holes through the poles, and removable pins extending through said cylinder holes and through said pole holes for releasably securing said flap means to said poles.

7. An apparatus according to claim 1 wherein said support means includes a rail means and including an additional movable member mounted for movement along said rail means, and a flap means mounted on said additional movable member being adapted to being engaged and moved by a foot of the user through the pool water.

8. A stationary exercise apparatus for therapeutic underwater use in a pool, said apparatus including a support means for resting the apparatus on a bottom of the pool in a stationary relation therewith, a pair of rigid elongated poles rotatably mounted at one end on said support means whereby said poles can be moved backwardly and forwardly relative to said support means by a user of the apparatus, and a flap means mounted on and extending from said elongated poles for movement therewith, said flap means including means for selectively varying the location of said flap means along said poles relative to said support means, whereby, in use of the apparatus, said flap means is disposed within and surrounding water, and the resistance to movement of the flap means through the water provides resistance to movement of the movable member.

9. An apparatus according to claim 8 wherein said support means includes a pair of parallel rail means, and including a second pair of movable members each of which is adapted to be engaged by a different foot of a user of the apparatus and each of which is mounted for movement along a different one of said rail means, and a flap means mounted on each of said second pair of movable members for providing resistance within the pool water to movement of said second pair of movable members.

10. An apparatus according to claim 8 wherein said flap means comprise two plates secured to opposite sides of a C-shaped support member including a pair of arms each of which terminates in a hollow cylinder, said cylinder being mounted on one of said poles in slidable fit therewith, said poles including a plurality of holes spaced apart along the length of the poles, said cylinders having holes therethrough along axes parallel to the axes of the holes through the poles, and removable pins extending through said cylinder holes and through said pole holes for releasably securing said flap means to said poles.

* * * * *